United States Patent [19]

Handy et al.

[11] Patent Number: 4,508,472

[45] Date of Patent: Apr. 2, 1985

[54] METHOD FOR CONTROLLING MOISTURE-EXPANSIVE CLAY SUPPORTING BUILDING FOUNDATIONS

[75] Inventors: Richard L. Handy, Ames; James A. Murray, Des Moines, both of Iowa

[73] Assignee: Iowa State University Research Foundation, Inc., Ames, Iowa

[21] Appl. No.: 438,782

[22] Filed: Nov. 3, 1982

[51] Int. Cl.[3] ..... E02D 3/12; E02D 31/10

[52] U.S. Cl. ..... 405/229; 52/167; 405/263

[58] Field of Search ..... 405/50, 229, 263, 264, 405/267; 52/167, 169.5, 169.14, 742

[56] References Cited

U.S. PATENT DOCUMENTS

| | | | |
|---|---|---|---|
| 3,274,783 | 9/1966 | Handy | 405/266 |
| 3,667,236 | 6/1972 | Rosene | 405/50 |
| 3,875,751 | 4/1975 | Paus | 405/263 |
| 4,015,432 | 4/1977 | Ball | 405/229 |
| 4,174,912 | 11/1979 | Peterson | 405/263 X |
| 4,187,041 | 2/1980 | Boman et al. | 405/263 |
| 4,380,408 | 4/1983 | Loken et al. | 405/263 |

OTHER PUBLICATIONS

Ho, C. and R. L. Handy, Special Report, 42nd Annual Meeting of Highway Research Board, NAS-NRC, Jan. 1963.

Lyons, J. W., Engineering News-Record, 101-105, Aug. 15, 1957.

Jones, D. E., Civil Engineering-ASCE, 49-51, Aug. 1973.

Godfrey, K. A., Civil Engineering-ASCE, 87-91, Oct. 1978.

Gutschick, K. A., Building Foundation Stabilization with Lime, Paper Presented NLA Convention, Point Clear, Alabama, May 12, 1964.

Holtz, W. G., and S. S. Hart, Home Construction on Shrinking and Swelling Soils, Oct. 1978.

*Primary Examiner*—David H. Corbin

*Attorney, Agent, or Firm*—Tilton, Fallon, Lungmus

[57] ABSTRACT

A method for preventing or greatly reducing damage to building foundations resulting from the swelling of moisture-expansive clay beneath and about such foundations. The method includes the steps of first forming a trench about the foundation, the trench extending well below the basement or on-grade floor slab of that foundation, and then substantially filling the trench with an extrudable plastic mass of hydrated lime and water to help stabilize the moisture-expansive clay and to provide a yieldable buffer capable of being displaced upwardly to accommodate horizontal expansion of the clay beneath and about the foundation, thereby relieving lateral stresses and reducing upward forces against the floor slab.

16 Claims, 8 Drawing Figures

METHOD FOR CONTROLLING MOISTURE-EXPANSIVE CLAY SUPPORTING BUILDING FOUNDATIONS

BACKGROUND AND SUMMARY

The stabilization of soils containing water-expansive clay minerals (chiefly montmorillonite) by treating such soils with lime is well established. Stabilizing reactions of several types occur, with ion-exchange and agglomeration/flocculation reactions resulting in a reduction of plasticity of the clay soil and, over a more extended period, with a pozzolanic soil-lime reaction often resulting in the development of cementitious products of increased strength and moisture-barrier properties. Ho, C., and R. L. Handy, Special Report, 42nd Annual Meeting of Highway Research Board, NAS-NRC, January 1963; Lyons, J. W., Engineering News-Record, 101–105, Aug. 15, 1957. The goals of such treatment are to increase the soil strength and reduce the volume changes that occur in relation to the moisture content of such expansive soils and thereby limit the structural damage caused by such changes. It has been estimated that the swelling and shrinking of soils causes billions of dollars in damage to houses, commercial buildings, roads, and pipelines—considerably more than the damage caused by floods, hurricanes, tornadoes, and earthquakes. Jones, D. E., Civil Engineering—ASCE, 49–51, August 1973; Godfrey, K. A., Civil Engineering—ASCE, 87–91, October 1978.

Various techniques have been offered for treating moisture-expansive soils with lime to stabilize them and control swelling. One such procedure involves mechanically mixing the soil of a building site with hydrated lime, either by mixing the lime into the soil in situ by equipment similar to that used for cultivation, or by removing a layer of soil, mixing it with lime in a suitable mixer, and then replacing the lime-containing soil. Another technique involves first ponding the foundation subsoil to pre-expand it, followed by lime-stabilizing of the top 12-inch layer. Gutschick, K. A., paper presented at NLA Convention, Point Clear, Ala., May 12, 1964. A modified ponding technique has also been suggested consisting of first forming a maze of cross trenches 6 inches wide and 3 feet deep, on 10 foot centers in one direction and 30 foot centers in the other, and then filling such trenches with hydrated lime to a depth of 12 inches, followed by back-filling with washed pea gravel. The trenches are then flooded, using enough water to keep them constantly wet but not overflowing. Moisture content is checked periodically to a substantial depth (10 feet) about the site area, the treatment being considered complete in about 2 to 3 weeks when the moisture content reaches approximately 30 percent.

While such techniques have met with varying degrees of success for preparing a site prior to the laying of a foundation, they are less suitable or effective for treating a site on which a building foundation is already located. The soil about such a foundation may be removed and replaced with compacted non-expansive soil or with chemically-treated (i.e., lime-treated) on-site soil. Holtz, W. G., and S. S. Hart, Home Construction on Shrinking and Swelling Soils, October 1978. Such a procedure may produce a cementitious mass that reduces entry of water, but substantial expansive forces tending to cause damage to basement walls, and particularly upward forces tending to heave a floor slab (whether below-grade or on-grade) will continue to develop.

U.S. Pat. No. 3,274,783 discloses a method for stopping landslides and soil shear failures by forming bore holes about the periphery of a foundation and then introducing hydrated lime into such holes to at least the top of the perched water table-containing soil stratum beneath the foundation. The hydrated lime increases the mechanical strength of the saturated montmorillonitic clay strata, thereby preventing soil shear failure. While such treatment has been found effective in preventing or stopping landslides, it does not significantly reduce, and may even increase, the stresses that tend to cause damage to foundations in moisture-expansive soils. Similarly, shallow trenching about a foundation, even where such a trench is used to connect the top portions of bore holes formed as disclosed in such patent, and then filling the trench with hydrated lime, have been found ineffective in preventing or appreciably reducing foundation damage, especially damage caused by uplifting of below-grade or on-grade floor slabs.

This invention is therefore concerned with a method for treating the moisture-expansive soil about a pre-existing foundation to relieve stresses that might otherwise develop and damage the foundation, particularly those stresses tending to cause an uplifting and cracking of basement floor slabs and on-grade floor slabs. It is a specific object of this invention to provide a method that not only is effective in controlling expansive clay soil beneath and about such a foundation to avoid or at least greatly reduce the likelihood of such damage, but to do so by a sequence of relatively uncomplicated and inexpensive procedural steps.

One aspect of this invention lies in recognizing that the upward forces exerted by swelling clay soil beneath a floor slab may be relieved by trenching about the foundation to a depth substantially below that slab and then substantially filling the trench with hydrated lime to provide a compliant lime buffer zone about the foundation capable of accommodating lateral expansion of the soil beneath the slab and thereby reducing the uplifting forces exerted upon the slab. Such buffer zone also cushions or absorbs the horizontal forces directed towards the side walls of a basement foundation while, at the same time, allowing lime to diffuse into the soil about and beneath the foundation to cause stabilization of that soil.

Briefly, the method includes the steps of first trenching along at least one side of the concrete foundation of a building structure, and usually about the entire perimeter of that foundation, to a depth well below the level of the concrete floor slab of that foundation, and then substantially filling the trench with a flowable plastic mass of hydrated lime and water. The vertically-displaceable contents of the trench relieve lateral stresses caused by expansion of the surrounding subsoil and reduce the upward forces generated by the absorbent clay beneath the foundation slab. In addition, the hydrated lime slowly diffuses into and stabilizes the surrounding subsoil to reduce soil expansion and plasticity.

The depth of the lime-containing trench should be at least 6 inches below the floor slab of the foundation and extend below any footing that may be provided as part of that foundation. Greater depths are preferred because of the greater capacity of the lime buffer or cushion to accommodate lateral expansion of the clay beneath the slab. The widths of the trench should be within the range of about 2 to 12 inches, preferably 3 to 5 inches, and be spaced from the periphery of the foundation a distance up to about 8 feet, preferably no more than about 3 feet. Along those sides of the foundation facing uphill slopes, parallel vertical trenches spaced 2 to 8 feet apart, preferably about 3 to 5 feet apart, may be provided to accommodate lateral creep of the soil and to promote greater stabilization of the soil between the parallel trenches.

Other features, advantages, and objects of the invention will become apparent from the specification and drawings.

DRAWINGS

DETAILED DESCRIPTION

Figure 1:
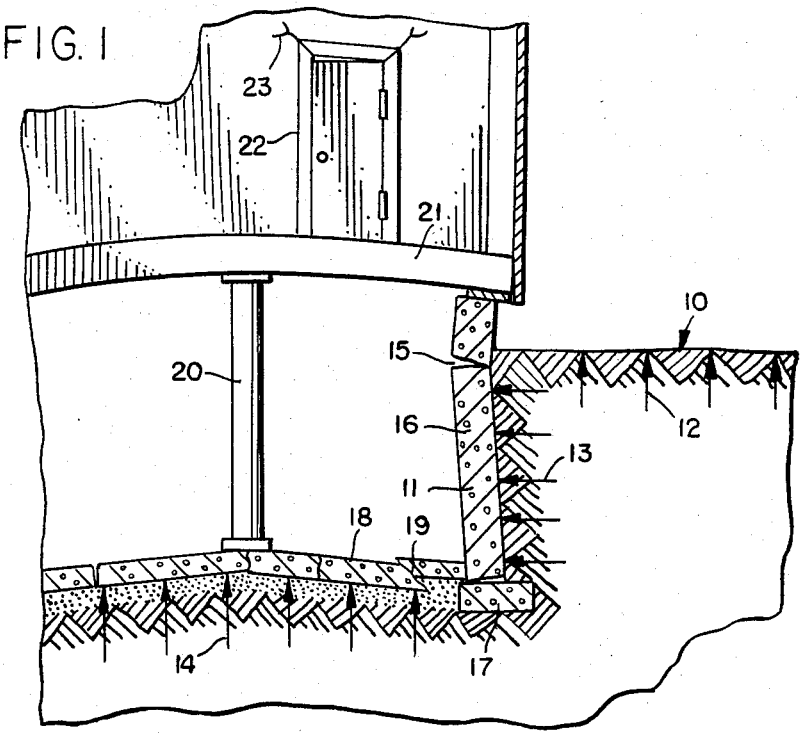
FIG. 1 is a diagrammatic vertical sectional view depicting in somewhat exaggerated form for purposes of illustrating the damage to a building structure that may be caused by the swelling of moisture-expansive soil about and below the foundation, as generally experienced in the prior art.

Referring to the drawings, FIG. 1 indicates the problems that may be encountered when a building structure is constructed on fine-grained soil, specifically, soil containing moisture-expansive clay. Volume changes in soil are caused by the chemical and physical attraction of water molecules to the tiny clay plates that make up the expandable, montmorillonitic clay mineral. As water is made available to the clay, the spacing between the plates increases resulting in expansion of the soil. In a sample of pure montmorillonite, the plates may expand so much that the sample increases up to 15 times its original volume. While most montmorillonitic clay soils will not expand over 35 to 50 percent, the pressures on a building foundation by such volume increases are responsible for most swelling soil damage.

In the illustration, the clay-containing soil 10 around and beneath foundation 11 expands as it absorbs water in the directions indicated by arrows 12–14. Cracks 15 appear in foundation wall 16 in response to horizontal forces in the direction of arrows 13; if such forces are great enough, the entire wall 16 may be displaced inwardly on its footing 17, causing a shearing of the concrete floor slab 18 as indicated by the shear fracture at 19. Because of the resistance of the floor slab to shearing in response to such horizontal compressive forces, inward movement of basement wall 16 may be greater at higher levels, causing the extreme inward buckling indicated in the drawing.

Vertical expansion of the soil beneath floor 18 in the direction of arrows 14 may result in uplifting, cracking, and differential heaving of the floor slab. Upward displacement of interior column or load-bearing wall 20 results in arching of floor joists 21, distortion or misalignment of doorways 22, and the development of cracks 23 about doors and other stress points. Depending on the location and construction of the foundation 11, the composition of the moisture-expansive soil 10, and the amount of water accumulated by the soil and the pressures and extent of expansion generated thereby, the extent of damage may range from occasional cracks in the foundation and upper structure to severe buckling and heaving of the foundation and irreparable damage to the building structure as a whole. While FIG. 1 illustrates the problems in connection with a building structure having a basement foundation, similar problems may develop with a foundation in which the floor slab is on-grade. Specifically, swelling of the moisture-expansive clay soil beneath an on-grade floor slab may result in cracking, shearing, and differential heaving of that slab, and resulting damage to the building structure supported on that slab. Although much effort has been made in recent years to reinforce floor slabs so that they act as beams and bridge across the uneven uplift pressures, such an approach has had varying success and severely limits the size of slab that can economically be constructed. The term "floor slab" is used herein to mean both on-grade slabs, with or without footings or peripheral reinforcement, and basement floor slabs, both types of slabs ordinarily being formed of poured concrete.

Figure 3:
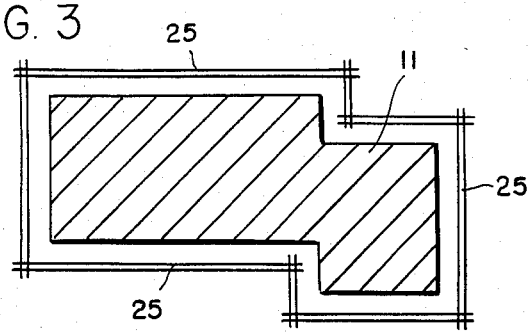
FIG. 3 is a reduced diagrammatic view showing the perimetric extent of the trench.

In practicing this invention, a vertical trench 25 is first formed alongside the foundation 11, the trench extending to a depth well below foundation floor slab 18, including its footing 17. The trench should extend at least 6 inches beneath the foundation 11, preferably to a depth of 3 to 4 feet therebelow. The trench should be of substantially uniform depth and, as indicated in FIG. 3, would ordinarily extend completely about the perimeter of the foundation 11. Exceptions might occur under certain circumstances; for example, if the foundation is situated on sloping terrain, it is possible that a trench need be formed only along the uphill side of the foundation and the sides of the foundation adjacent thereto, the trench along the downhill side either being relatively shallow (although having its lower limits along the same horizontal plane as the portions of the trench along the other sides of the foundation) or being omitted entirely.

The width of the trench should fall within the general range of 2 to 12 inches, the preferred range being approximately 3 to 5 inches. The selected width should reflect the anticipated lateral movement of adjacent soil; for a typical expansive clay soil as found in western United States containing approximately 20 to 50 percent by weight of montmorillonitic clay, a trench 4 inches in width is believed effective for a period of about 20 years, disregarding the soil-stabilizing influence of the lime introduced into such trench. The trench or trench sections should be parallel to the sides of the foundation wall 16 (FIG. 3) and should be located 0.5 to 8 feet, and preferably 1 to 3 feet, from the sides of that foundation. The minimum spacing from the foundation of an existing structure is necessary to avoid loss of bearing capacity for the footing of the foundation.

Following the trenching operation, the trench is substantially filled with a thick but flowable slurry consisting essentially of hydrated lime and water. The hydrated lime should be composed predominately of calcium hydroxide, although small amounts of other components often found as impurities in hydrated lime, such as magnesia, may be tolerated. In the best mode for practicing the invention, hydrated lime powder is premixed with 20 to 60 percent by weight water to form a thick slurry or plastic mass which is then poured into the trench to fill it to grade, or to a level only slightly (i.e., no more than about 1 foot) below grade. Homogeneity of the fill material is thereby assured by such premixing. However, under some circumstances satisfactory but less-effective results may be achieved by introducing the hydrated lime into the trench in a dry powdered state and then mixing the hydrated lime in situ with ground water, and/or with water introduced into the open trench, to form an extrudable or deformable mass of buffer material 26.

Figure 4:
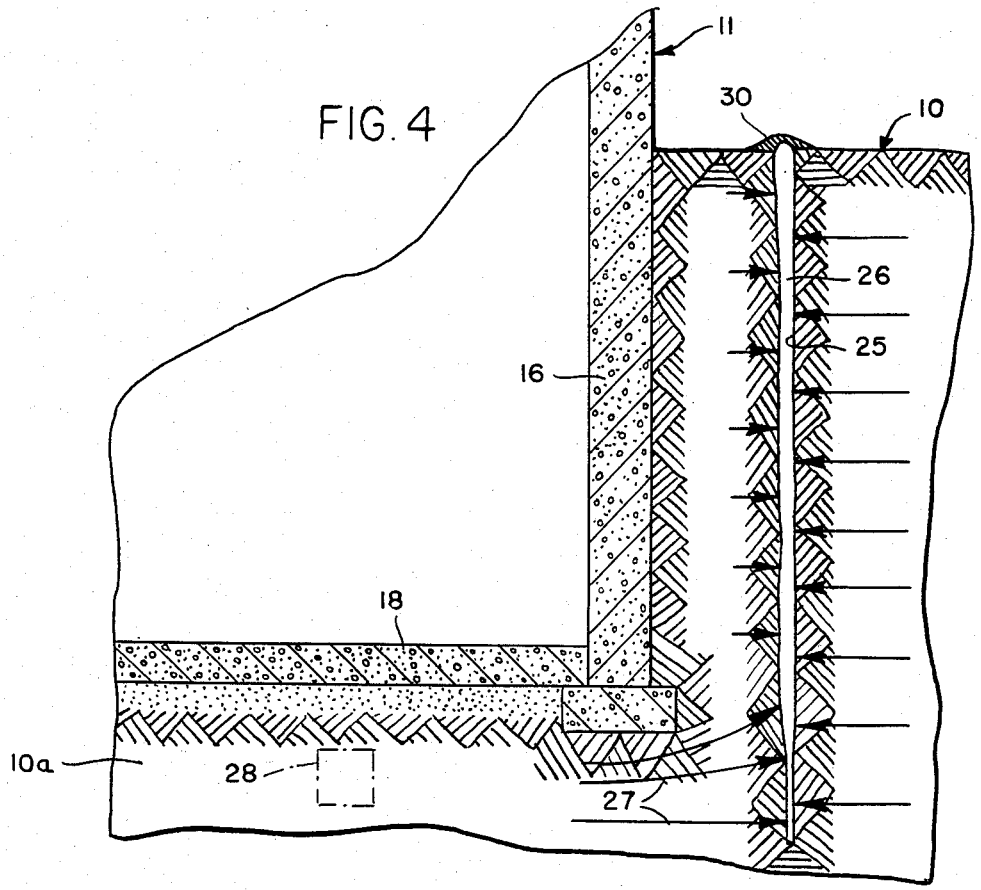
FIG. 4 is a vertical sectional view similar to FIG. 2 but schematically illustrating vertical displacement of the buffer as the trench is partially collapsed in response to lateral stresses.
Figure 5:
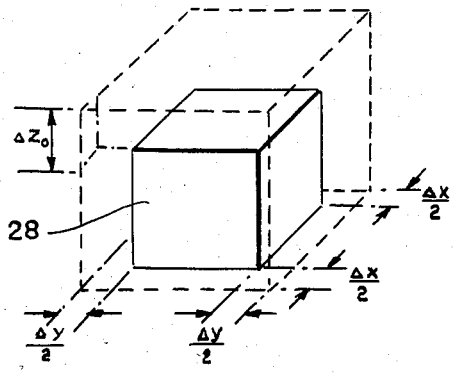
FIGS. 5 and 6 are perspective views of a cube of moisture-expansive soil graphically and schematically illustrating the differences in the directions of expansion of soil beneath a floor slab surrounded (FIG. 5) and not surrounded (FIG. 6) by a collapsible trench filled with a pliant, displaceable buffer material.
Figure 6:
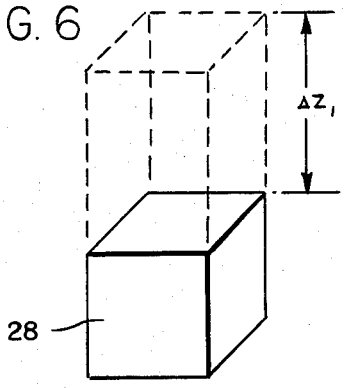

In the presence of soil moisture, the barrier or buffer 26 retains sufficient plasticity to be extruded or displaced upwardly in response to lateral pressures caused by horizontal expansion of the surrounding soil (FIG. 4). One aspect of this invention lies in the recognition that where the depth of the trench substantially exceeds the depth of the foundation, as shown in the drawings, moisture-expansive clay soil 10*a* beneath floor slab 18 is allowed to expand laterally, as represented by arrows 27 in FIG. 4, thereby relieving the extent of upward expansion of such soil. To illustrate such stress relief, FIG. 5 diagrammatically depicts a cube 28 of moisture-expansive clay soil located as indicated in phantom lines in FIG. 4. The cube 28 of expansive clay soil is free to expand laterally in directions x and y, as represented by arrows 27, because of the cushioning effect of extrudable buffer 26 within trench 25, it being noted that the bottom of trench 25 is no higher than the bottom of cube 28. Because of the lateral stress relief provided by the peripheral trench and extrudable filler or buffer material, expansion of cube 28 is essentially equal in the x, y, and z directions: $\Delta x = \Delta y = \Delta z_o$. For comparison, FIG. 6 illustrates cube 28 under the same conditions except that trench 25 and filler material 26 are omitted. Expansion in the horizontal x and y directions, and in a downward vertical direction, is prevented by the soil continuum, so that all expansion must be transformed into the upward vertical direction: $\Delta x = \Delta y = o$; $\Delta z_1 = 3\Delta z_o$. That is, for any given volume expansion (150 percent is represented in FIGS. 5 and 6) the vertical heave ($\Delta z_1$) with lateral restraint will be as much as 3 times the heave ($\Delta z_o$) without lateral restraint.

In addition to providing an upwardly displaceable or extrudable mass for directly reducing horizontal stresses, and indirectly relieving vertical stresses that tend to cause fracturing and heaving of a foundation slab (whether below-grade or on-grade), the mass 26 of hydrated lime also causes stabilization of the clay soil in the vicinity of the trench. Such stabilization involves cation exchange and agglomeration/flocculation reactions, and may also include soil-lime pozzolanic reactions, all as well-known in the prior art and as disclosed in references identified above. Such reactions reduce the plasticity and swell properties of the clay soil, the effects being more pronounced immediately adjacent the trench but also extending laterally therefrom as a result of ion migration or diffusion. Since the trench is located in close proximity to the sides of the foundation and extends well below that foundation, some stabilization of the soil beneath the floor slab may also be expected to occur. The stabilizing reactions not only reduce the extent of swelling of the soil about and below the foundation 11, but promote more sharply-defined confinement of the cushioning material 26 within the trench and more uniform application of the expansive forces thereagainst by reason of the development of cementitious reaction products (such as various types of hydrated calcium silicate and calcium aluminate) in the soil bordering the trench.

Figure 2:
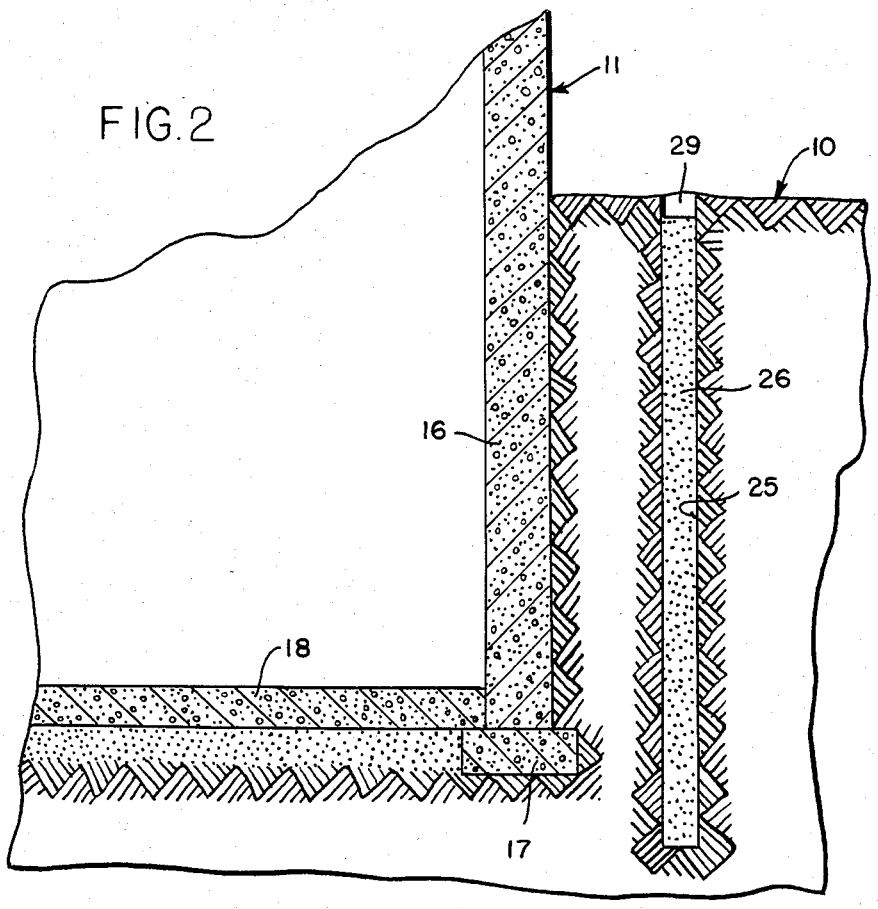
FIG. 2 is a fragmentary diagrammatic sectional view of a building foundation having an adjoining vertical trench formed in accordance with this invention.

While the trench 25 may be filled completely to ground level with hydrated lime and water, it is preferable from the standpoint of appearance to leave a space 29 near the surface (FIG. 2), as previously indicated, and then fill that space with topsoil. Some lifting of the topsoil 30 may be expected to occur, as represented in FIG. 4, as the material 26 within the trench is displaced upwardly in response to subsoil expansion. Ordinarily such lifting would be gradual, occurring over a period of months or years, and would be concealed by shrubbery planted about the foundation; however, some minor landscaping or releveling may become necessary or desirable.

Figure 7:
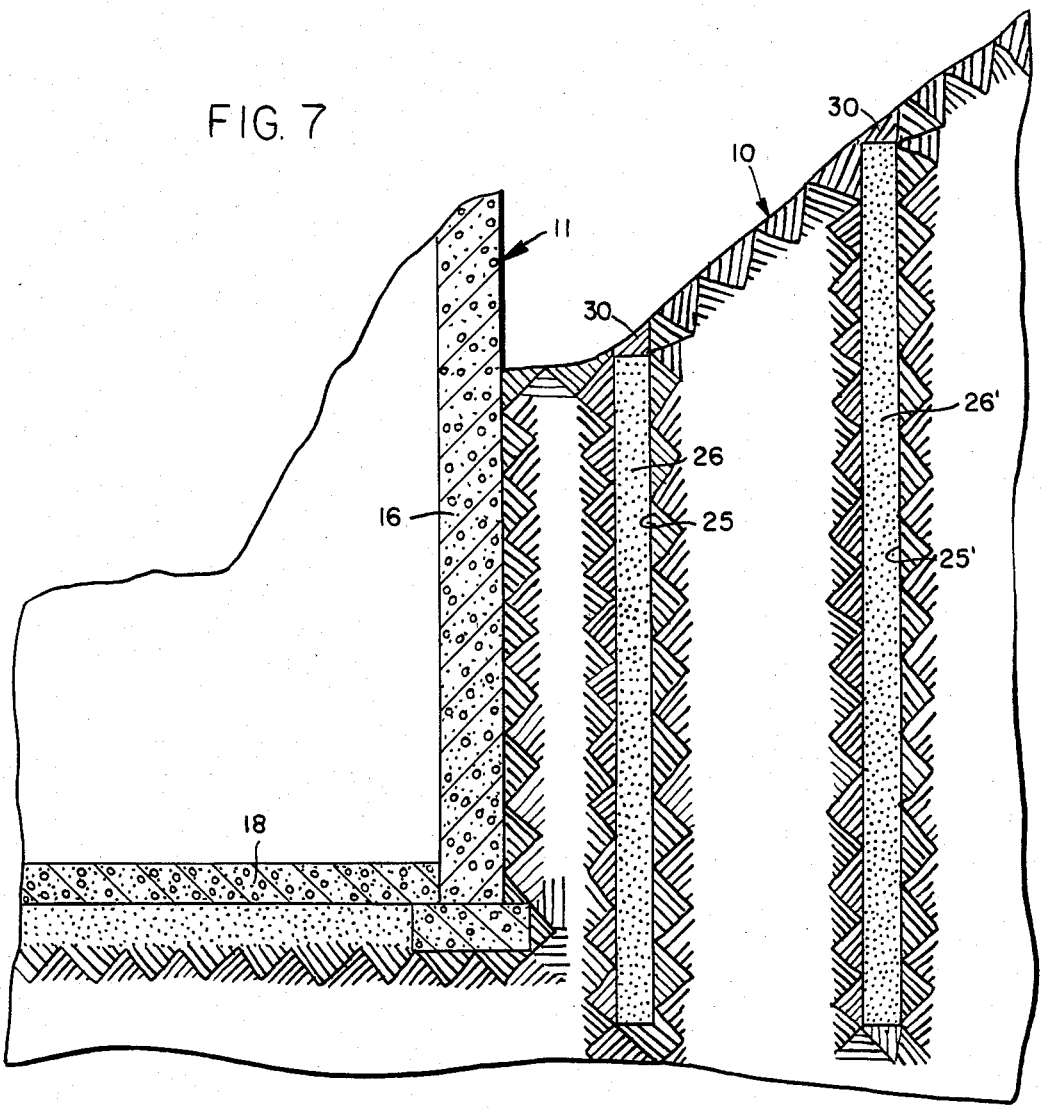
FIG. 7 is a diagrammatic and fragmentary vertical sectional view showing the provision of a double trench arrangement.
Figure 8:
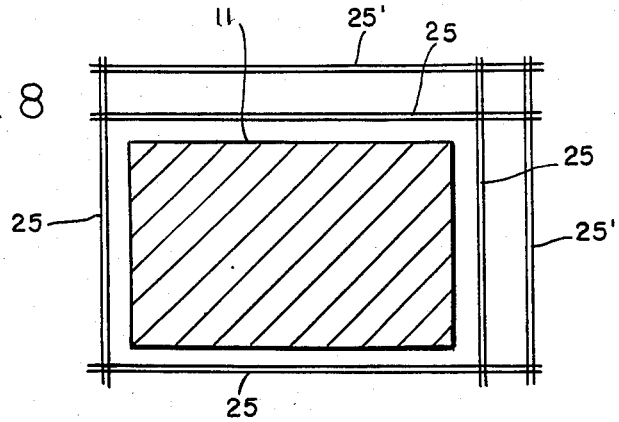
FIG. 8 is a diagrammatic overhead view on a reduced scale showing such a double trench arrangement.

Lateral movement of the surrounding soil over an extended period may substantially close trench 25. Retrenching, and the infusion of additional amounts of hydrated lime and water, may then be undertaken. On a sloping site, where the trench-closing and lime-extruding actions tend to be accelerated on the uphill side, a somewhat wider trench, but still no wider than approximately 12 inches, may be provided. As an alternative to providing a wider trench on the uphill side, it is preferred that two or more parallel trenches, spaced 2 to 8 feet apart, and preferably 3 to 5 feet apart, be provided as depicted in FIGS. 7 and 8. It will be observed from FIG. 8 that double trenches 25 and 25' are provided on two adjacent sides, a desirable arrangement if the terrain slopes upwardly away from the upper right corner of the foundation as shown. Even on level terrain it may be advisable to provide parallel trenches as, for example, where the montmorillonitic clay content of the soil is unusually high. In such a case, the plural trenches should extend completely about the foundation and the spacing between such trenches should be substantially uniform. In addition to the greater cushioning or stress-relieving effect achieved by multiple parallel trenches, it is believed evident that such an arrangement promotes greater lime stabilization of surrounding soil.

While in the foregoing we have disclosed the method of the invention in considerable detail for purposes of illustration, it will be understood by those skilled in the art that many of these details may be varied without departing from the spirit and scope of the invention.

We claim:

1. A method for preventing or reducing the heaving of a floor slab and other damage to an existing building foundation that might result from the swelling of moisture-expansive clay beneath and about such foundation, comprising the steps of trenching along the sides of said foundation to form a vertical trench having a depth extending substantially below the floor slab of said foundation; and then substantially filling said trench with a mixture of hydrated lime and water to (a) help stabilize the moisture-expansive clay beneath and about said foundation and (b) provide a yieldable mass capable of upward displacement within said trench to accommodate horizontal expansion of the clay beneath and about said foundation, thereby allowing lateral expansion of the clay below said floor slab and reducing upward pressure on said slab.

2. The method of claim 1 in which said mixture is prepared outside of said trench by mixing hydrated lime and water to form a thick homogeneous hydrated lime slurry; said hydrated lime and water then being introduced into said trench in slurry form during said filling step.

3. The method of claim 1 in which said mixture is prepared within said trench by individually introducing water and solid, finely-divided hydrated lime into said trench, and then mixing said lime and water in situ to form a thick hydrated lime slurry within said trench.

4. The method of claims 2 or 3 in which said slurry comprises a mixture of hydrated lime and approximately 20 to 60 percent by weight water.

5. The method of claim 1 in which said trenching includes forming a substantially continuous trench about the perimeter of said building foundation.

6. The method of claims 1 or 5 in which said trench is spaced substantially uniformly from said foundation.

7. The method of claim 6 in which said trench is uniformly spaced from said foundation a distance within the range of about 0.5 to 8.0 feet.

8. The method of claim 7 in which said spacing is within the range of 1 to 3 feet.

9. The method of claim 1 in which said trench has a width falling within the range of 2 to 12 inches.

10. The method of claim 9 in which said trench has a width within the range of 3 to 5 inches.

11. The method of claim 1 in which said trench is of substantially uniform depth.

12. The method of claim 11 in which said trench has a uniform depth at least 6 inches below said floor slab of said foundation.

13. The method of claims 1 or 5 in which there is the further step of forming a second vertical trench parallel with and spaced outwardly from said first-mentioned trench, and then substantially filling said second trench with said mixture of hydrated lime and water.

14. The method of claim 13 in which said second trench is spaced uniformly outwardly from said first trench a distance within the range of approximately 2 to 8 feet.

15. The method of claim 14 in which the spacing between said first and second trench falls within the range of approximately 3 to 5 feet.

16. The method of claim 13 in which said second trench extends to substantially the same uniform depth as said first trench.

* * * * *